US007940257B2

(12) United States Patent
Zhao et al.

(10) Patent No.: US 7,940,257 B2
(45) Date of Patent: May 10, 2011

(54) METHODS FOR SEGMENT DRIVER CIRCUITS AND APPLICATION SPECIFIC SEG DECODERS IN LCD DRIVER SYSTEMS

(75) Inventors: Chunbo Zhao, Shenzhen (CN); Wei Feng, Shenzhen (CN); Yun Yang, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 868 days.

(21) Appl. No.: 11/903,355

(22) Filed: Sep. 20, 2007

(65) Prior Publication Data

US 2008/0068370 A1 Mar. 20, 2008

(30) Foreign Application Priority Data

Sep. 20, 2006 (CN) ..... 2006 1 0062707

(51) Int. Cl.
*G09G 5/00* (2006.01)

(52) U.S. Cl. ..... 345/214; 345/211

(58) Field of Classification Search ..... 345/204, 345/211, 214

See application file for complete search history.

(56) References Cited

U.S. PATENT DOCUMENTS

| | | | | |
|---|---|---|---|---|
| 7,535,451 | B2 * | 5/2009 | Nohtomi et al. | 345/98 |
| 2003/0011582 | A1 * | 1/2003 | Morita | 345/204 |
| 2004/0189581 | A1 * | 9/2004 | Sako et al. | 345/98 |

* cited by examiner

*Primary Examiner* — Quan-Zhen Wang
*Assistant Examiner* — Calvin C MA
(74) *Attorney, Agent, or Firm* — Venture Pacific Law, PC

(57) ABSTRACT

This invention describes methods and circuits for the segment driver circuit in a LCD driver system as well as application specific SEG decoder. The methods include the following steps: the array signal undergoes an inversion process (from 1 to 0, or from 0 to 1); the data and the array signal that has been processed through the inversion process then undergo a matrix operation; the signal that has gone through the matrix operation is then sent to a BBM (break before make) circuit. The signal processor of the application specific SEG decoder performs the inverse operation (from 1 to 0, or from 0 to 1) on the array signal; the decoding circuit performs the matrix operation on the signal that has been inversed (from 1 to 0, or from 0 to 1) before sending it to the BBM circuit. The methods described in this invention first process the array signal through field processing and inverse processing (from 1 to 0, or from 0 to 1) before undergoing the matrix operation, rather than first performing the matrix operation and then selecting an output based on the field signal. Therefore, this invention enhances the SEG decoder by simplifying the circuitry, reducing energy consumption, lowering cost, and making it easier to realize.

9 Claims, 7 Drawing Sheets

$$\begin{bmatrix} -1 & 1 & 1 & 1 \\ 1 & -1 & 1 & 1 \\ 1 & 1 & -1 & 1 \end{bmatrix}$$

$$\begin{bmatrix} 0 & 0 & 0 & 0 & 1 & 1 & 1 & 1 \\ 0 & 0 & 1 & 1 & 0 & 0 & 1 & 1 \\ 0 & 1 & 0 & 1 & 0 & 1 & 0 & 1 \end{bmatrix}$$

METHODS FOR SEGMENT DRIVER CIRCUITS AND APPLICATION SPECIFIC SEG DECODERS IN LCD DRIVER SYSTEMS

CROSS REFERENCE

This application claims priority from a Chinese patent application entitled "Methods for Segment Driver Circuits and Application Specific SEG Decoders in LCD Driver Systems" filed on Sep. 20, 2006, having a Chinese Application No. 200610062707.0. This Chinese application is incorporated here by reference.

FIELD OF INVENTION

This invention involves LCD driver systems and, in particular, it involves methods for a segment driver circuit in a multi-line LCD driver system.

BACKGROUND

LCD has the advantages of being small in size, light weight, requiring low voltage, and having low energy consumption that enable it to dominate a broad market in the portable display domain. In particular, the STN (super twisted nematic) LCD possesses unique advantages and it holds a significant market share in the medium to small size LCD market segment.

STN LCD and TFT LCD are similar in that they demand higher display quality and response speed, fewer shadow occurrences, and improved price to performance ratio. Meanwhile, they also have lower energy consumption, higher contrast, lesser cross talk, broader temperature range and faster frame frequency response.

The advent of MLA (multi-line addressing) driver methods has vastly improved the disadvantages of SLA (simple-line addressing) driver methods. MLF methods can significantly improve the aforementioned issues, allowing it to be more satisfactory in meeting application requirements.

The MLA driver methods have continued to improve with the advancement of technology. Currently, the MLA driver methods can be divided into two categories. One is the traditional MLA adjustment methods realized using N*N array algorithms; another one is an improved MLA modulation methods using (N−1)*N array algorithm. In US20040189581 patent application, the Kawasaki company provides an improved MLA driver array algorithm.

In the actual circuitry, it includes a SEG decoder, a BBM (break before make) circuit, a level-shifter and a level-selector, etc. The displayed data is output from the register to the SEG decoder; it is then processed through the decoder and the resulting control signal is processed again in the BBM circuit; then the signal is sent to the level-shifter; after the level is shifted, it is output to the level-selector to select the segment driver voltage; then the signal is output to the LCD panel to attain the displayed data. When processing a signal, the SEG decoder first conducts the decoding, then performs field processing and the inverse operation (from 1 to 0, or from 0 to 1) as it is described in the November, 2003 technology magazine <*Research & Progress of SSE*> article titled "Design of LCD Multi-line Selection Driver IC". To first decode (meaning to first perform array algorithm) requires each field to have its corresponding decoder circuit that specifically performs the matrix operation and thus resulting in complicated decoder circuitry; moreover, the original circuit that is used for matrix operation utilizes multiplication and addition circuits or dynamic circuits and thus these circuits themselves are already complicated, having large surface area and high energy consumption. Therefore, it is desirable to have methods allowing for simplified circuitry, low energy consumption, low cost, and easy to realize segment driver circuits for a LCD driver system.

SUMMARY OF INVENTION

An object of the present invention is to provide methods and circuits allowing for simplified circuitry, low energy consumption, low cost, and easy to realize segment driver circuit in a LCD driver system.

Briefly, this invention describes methods and circuits for the segment driver circuit in a LCD driver system as well as application specific SEG decoder. The methods include the following steps: the array signal undergoes an inversion process (from 1 to 0, or from 0 to 1); the data and the array signal that has been processed through the inversion process then undergo a matrix operation; the signal that has gone through the matrix operation is then sent to a BBM (break before make) circuit. The signal processor of the application specific SEG decoder performs the inverse operation (from 1 to 0, or from 0 to 1) on the array signal; the decoding circuit performs the matrix operation on the signal that has been inversed (from 1 to 0, or from 0 to 1) before sending it to the BBM circuit. The methods described in this invention first process the array signal through field processing and inverse processing (from 1 to 0, or from 0 to 1) before undergoing the matrix operation, rather than first performing the matrix operation and then selecting an output based on the field signal. Therefore, this invention enhances the SEG decoder by simplifying the circuitry, reducing energy consumption, lowering cost, and making it easier to realize.

An advantage of the present invention is that it provides methods and circuits allowing for simplified circuitry, low energy consumption, low cost, and easy to realize segment driver circuit in a LCD driver system.

DESCRIPTION OF DRAWINGS

The foregoing and other objects, aspects and advantages of the invention will be better understood from the following detailed description of the preferred embodiments of this invention when taken in conjunction with the accompanying drawings in which.

Figure 1:
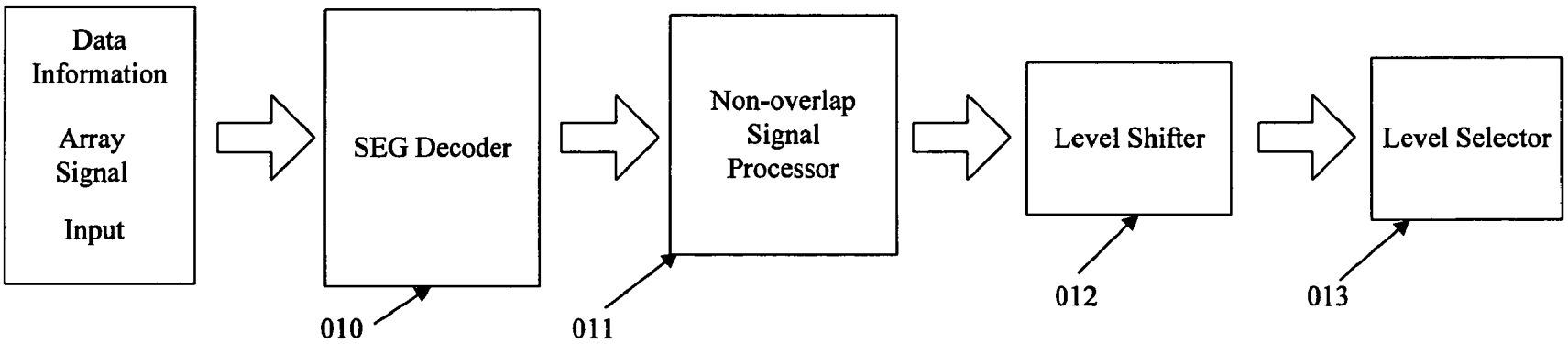
FIG. 1 illustrates an embodiment of the principle structure of the segment driver circuit of this invention.

The following is further explanation of the present invention based on the figures and the embodiments of this invention.

DETAILED DESCRIPTION OF THE PREFERRED EMBODIMENTS

One of the technology problems that this invention aims at solving is to provide a method that has simplified circuitry, low energy consumption, low cost, and easy to realize segment driver circuit in a LCD driver system.

The methods include the following operational steps:

A. The control circuit outputs the data from the register to the SEG decoder; simultaneously, the array signal that is controlled by the field signal is also sent to the SEG decoder;

B. SEG decoder processes the data and outputs it to a BBM circuit;

C. BBM circuit processes the signal and then sends it to a level-shifter;

D. after the level is shifted, the signal is output to a level-selector;

E. after the level-selector selects the voltage, the signal is sent to the display panel electrode and the data is shown on the display panel.

Its characteristics are: The said step B comprises the following steps:

B1. first perform inverse operation (from 1 to 0, or from 0 to 1) on the array signal B2. data signal and the array signal that has been processed through the inversion operation then undergo a matrix operation;

B3. The signal that has gone through the matrix operation is then sent to the BBM circuit in step C.

Step B has the following steps:

B1. Signal processor first performs inverse operation (from 1 to 0, or from 0 to 1) on the array signal;

B2. data signal and the array signal that has processed through the inversion operation are simultaneously sent to the decoder for the matrix operation;

B3. Based on the output from the decoder, the level control selector selects a corresponding level control signal which is then output to the BBM circuit in step C.

The second technology problem this invention aims to solve is to provide an application specific SEG decoder in the methods for said segment driver circuit.

Said SEG decoder comprises of a signal processor that can perform an inverse operation (from 1 to 0, or from 0 to 1) on the array signal and a decoder circuit that can perform a matrix operation; the displayed data from the register is output to the SEG decoder; the resulting control signal is further processed by the BBM circuit, its characteristics are: the signal processor first performs an inverse operation (from 1 to 0, or from 0 to 1) on the array signal; decoder circuit performs the matrix operation on the array signal that has been inversed (from 1 to 0, or from 0 to 1) before sending it to the BBM circuit.

The decoder circuit includes a combinational logic decoder, a level control selector, a signal processor that performs the inverse operation (from 1 to 0, or from 0 to 1) on the array signal. The data signal and the array signal that has been processed through the inversion circuit are simultaneously sent to the decoder for matrix operation; based on the decoder output, the level control selector selects a corresponding level control signal which is then output to the BBM circuit.

The methods of this invention first perform field processing and inverse operation (from 1 to 0, or from 0 to 1) on the array signal followed by the matrix operation rather than conducting the matrix operation first before sending the signal based on the field signal. Therefore, the methods enhance the SEG decoder by providing simplified circuitry, lower energy consumption, lower cost, and ease of realization. Moreover, further improvement can be realized in the array algorithm circuit. The multiplication and addition circuits and dynamic circuit can be replaced by the combinational logic decoder to achieve the same functions resulting in simplified circuitry, reduced surface area, and simpler logic control.

Embodiments

The following is a detailed explanation of the preferred embodiment of this invention referencing the figures below. Moreover, the following explanation of the embodiments is not to improperly limit in the scope of the patent claims of this invention. Thus, all of the components mentioned in following description are not the essential constitution of this invention.

For the ease of comprehension, a simple introduction of the principles of MLA is provided before describing the embodiments.

MLA LCD driver method is a technology that addresses multiple lines at one time. It utilizes orthogonal functions based on orthogonal principles in its signal processing.

Based on the display of the liquid crystal and driver principle, it can be known that, through the COM and SEG electrodes, the LCD driver chip provides an address and data to the LCD panel. With the SLA driver method, the segment driver circuit outputs data at each timing cycle. While with the MLA driver method, the segment driver circuit outputs multiple lines of data message at each timing cycle. After several cycles, the output are layered and added, and the display panel obtains the data to display.

With the MLA driver method, if the orthogonal matrix used in processing the data is O−1((N−1)*N), it results in that the scan electrode (or common driver) signal being divided into N field cycles to output O arrays. The signal electrode (or segment driver) signal is obtained by processing the data from the register using orthogonal matrix O−1 ((N−1)*N).

From the theoretical mathematic analysis, if the row addressing signal is addressed according to the orthogonal matrix O, and the displayed data read from the register is D, then: signal electrode (or segment driver) output is $$S=O^{-1}D$$

In each pixel, the row and column compilation can be represented by the following mathematical relationship.

$$D=OO^{-1}D=ED$$

Through the row and column orthogonal operation, the monitor receives the data for the display.

Figure 2:
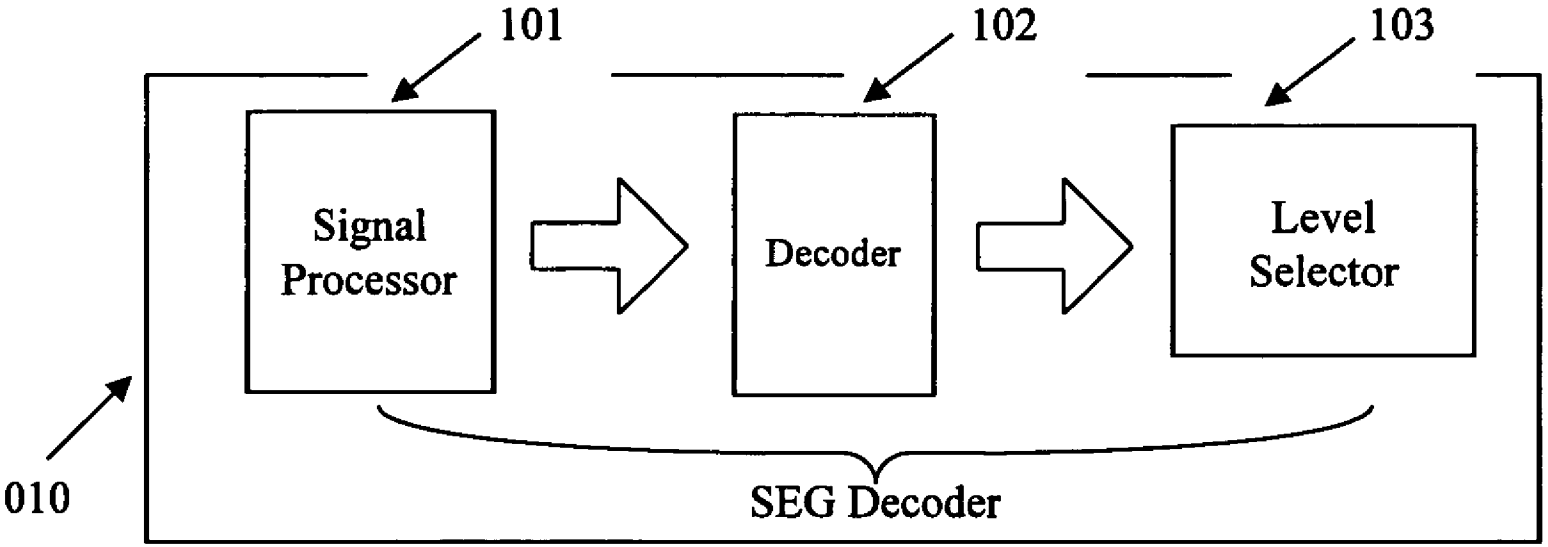
FIG. 2 illustrates an embodiment of the SEG decoder structure of this invention.

As shown in FIG. 1, the components in segment driver circuit of this invention include SEG decoder 010, BBM circuit 011, level-shifter 012 and level-selector 013. The array signal is processed through the SEG decoder 011, BBM 012 and level-shifter 012 before arriving at the level-selector 013. As shown in FIG. 2, the said SEG decoder includes signal processor 101, decoder 102, and voltage level control selector 103. Signal processor 101 first performs an inverse operation (from 1 to 0, or from 0 to 1) on the array signal; the data signal and the array signal that has been processed through the inversion operation are simultaneously sent to the decoder 102 for matrix operation; based on the decoder 102 output, the level control selector 103 selects the corresponding level control signal and then sending it to the BBM circuit 011.

The embodiment methods include the following steps:

A. control circuit outputs data from the data register to the SEG decoder 010 while the array signal controlled by the field signal is also sent to the SEG decoder 010;

B. SEG decoder 010 processes the data and outputs the signal to the BBM circuit 011;

C. the BBM 011 circuit processes the data and then sends the signal to the voltage level-shifter 012;

D. After the voltage level is shifted, the signal is sent to the voltage level-selector 013;

E. After the voltage level-selector selects the voltage, it sends the signal to the display panel electrode, and the data is displayed on the panel.

The described step A includes the following few steps:

A1. data is sent periodically from the memory cell.

A2. The output data is synchronized through the timer and stored in the register or latch;

A3. The data and the array signal are input simultaneously into the SEG decoder.

The described step B includes the following few steps:

B1. Signal processor first performs an inverse operation (from 1 to 0, or from 0 to 1) on the array signal. The array signal is based on the signal sent from field information;

B2. data signal and the array signal that has been processed through the inversion operation are simultaneously sent to the decoder;

B3. Based on the output of the decoder, the level control selector selects a corresponding level control signal. The signal is then output to the BBM circuit in step C.

The field signal mentioned in step B is needed because, in driving MLA, the same frame contains many fields; and also because the liquid crystal needs the AC load signal, thus the inverse operation (from 1 to 0, or from 0 to 1) is required.

The described step C performs the BBM process on the signal produced from step B.

Figures 3, 4, 5:
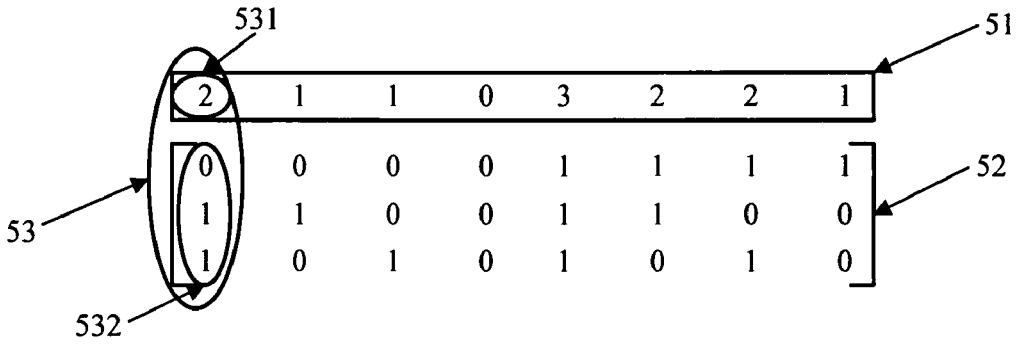
FIG. 3 illustrates an embodiment of the utilization of the orthogonal matrix of this invention.
FIG. 4 illustrates an embodiment of all the group arrangements for the displayed data of this invention.
FIG. 5 illustrates the theoretical values obtained based on a calculation based on an embodiment of this invention.

In step D, the voltage level shifter 012 changes the low voltage level to a high voltage level;

The embodiment of this invention utilizes the modulation matrix as shown in FIG. 3. The actual example of orthogonal matrix O of this invention is a 3 row by 4 column orthogonal matrix. The first row has four elements in the order of −1, 1, 1, 1; the second row has four elements in the order of 1, −1, 1, 1; the third row has four elements in the order of 1, 1, −1, 1. When choosing the orthogonal matrix, it is best to find one that is easy for the circuit to implement and that also minimizes the changes in the two neighboring rows. The modulation matrix must be determined first before the actual circuit is implemented.

The displayed data is as shown in FIG. 4. It is a three digit binary data group in which all data is represented within the range of 000-111.

In FIG. 5, based on the aforementioned principles, 51 is the product from the data in FIG. 4 and the first row of the transposed matrix of the orthogonal matrix O. 52 is the array resulted from the XOR operation between the data in FIG. 4 and each individual element from the first row of the transposed matrix of the orthogonal matrix O. There exists a corresponding relationship between 51 and 52; as is shown in 53, using XOR logic to obtain the sum of 532 results in 531. Therefore, in this invention, using this type of corresponding relationship, the XOR logic is applied in place of adder. According to the MLA principles, the 2, 3 value corresponding voltage in 51 is V; 0, 1 corresponding voltage is VN. The remaining three rows are calculated in the same manner, etc.

Figure 6:
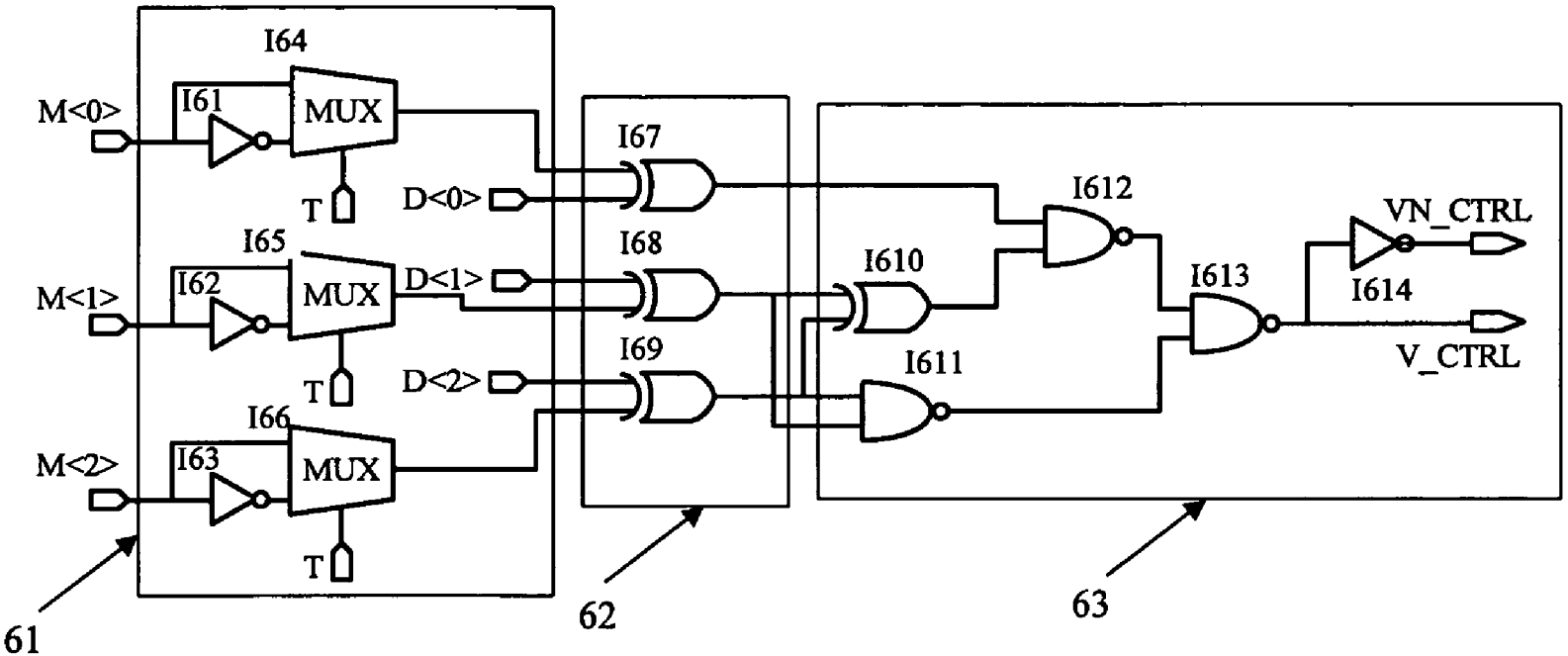
FIG. 6 illustrates an embodiment of the SEG decoder of this invention.

Per the modulation matrix used by the embodiment of this invention, the SEG decoder of the embodiment of this invention is shown in FIG. 6. The SEG decoder comprises of a signal processor 61, a decoder circuit 62 and a level control selector 63. The signal processor 61 contains three identical 2-to-1 multiplexer 164, 165 and 166 and three identical phase inverters I61, I62 and I63. The decoder 62 contains three identical XOR gates I67, I68 and I69. The level control selector 63 contains XOR gates 1610, three NAND gates I611, I612 and I613, and also a phase inverter I614.

The control node of the 2-to-1 multiplexer is an inverse signal T. The input signals resulting from the converted phase of M<0>, M<0>, the converted phase of M<1>, M<1>, and the converted phase of M<2>, M<2>are sequentially sent to the 2-to-1 multiplexers I64, I65, and I66. The 2-to-1 multiplexers I64, I65, and I66 outputs are sequentially sent to the XOR gates I67, I68, and I69. XOR gates I67 has another input signal which is data input D<0>; I68 has another input signal which is data input D<1> and I69 has another input signal which is data input D<2>. The I67 output is an input to NAND gate I612 and another input to I612 is the output of I610. The XOR gates I68 and XOR gates I69 outputs are the two input nodes of XOR gates I610. NAND gate I611 has two input nodes that are the outputs of XOR gates I68 and XOR gates I69. The I613 input is the outputs of I612 and I611. The I613 input is V_CTRL output node as well as phase inverter I614 input node. The I614 output node is VN_CTRL output node.

M<0:2> is done according to the array signal sent from field information. According to the array, the first field M<0:2> is listed as low level (−1), high level (1), and high level (1); the second field M<0:2> is listed as high level (1), low level (−1), and high level (1), etc. Because the LCD requires electric field exchange, therefore the voltage must be constantly flip-flopped. T is the inverse control signal and if T is at low level, M<0> is low and the 2-to-1 multiplexer 164 output is also at low level. If T is at high level, the 2-to-1 multiplexer I64 output is also at high level. The opposite is also opposite and the M<1>, M<2> follow the same concept. D<2:0> is the synchronized data from the data register.

While M<0:2> is sent to the decoding circuit 62 after it is processed through the signal processor 61, D<2:0> is simultaneously output from the register reaching 62 at the same time as the 61 output. The voltage level control selector 63 selects a voltage control signal of the corresponding level V_CTRL or VN_CTRL based on the decoding circuit output.

Figure 7:
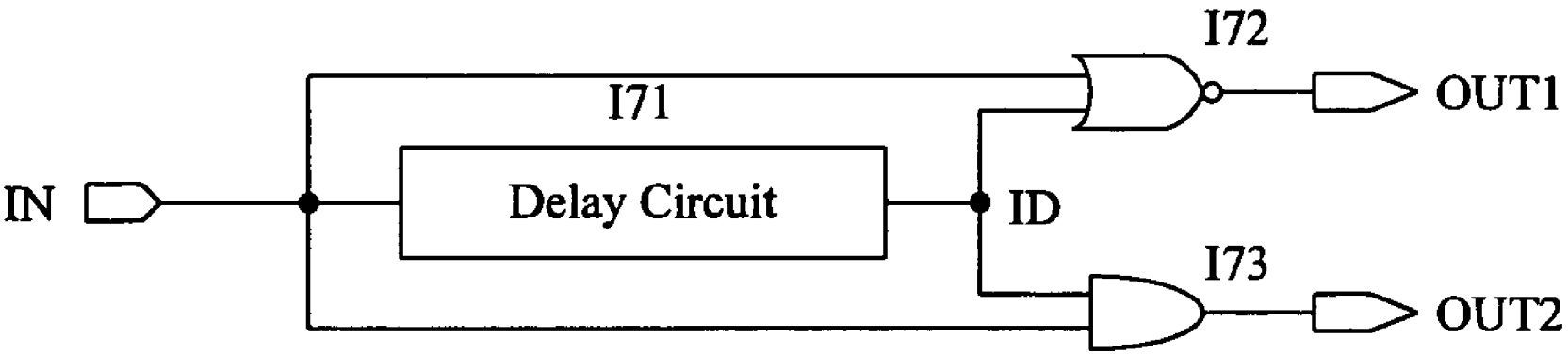
FIG. 7 illustrates an embodiment of the BBM circuit of this invention.

Without specific constraints, FIG. 7 is an embodiment of the BBM circuit principle of this invention. Input signal IN becomes ID after being processed through I71. Then IN and ID are processed through XOR gate I72 resulting in an output signal OUT1. Moreover, IN and ID are processed through AND gate I73 resulting in an output signal OUT2. OUT1 and OUT2 are non-overlapping control signals. A delay circuit I71 can use a phase inverter for delay completion or use a RC circuit for delay realization.

Figure 8:
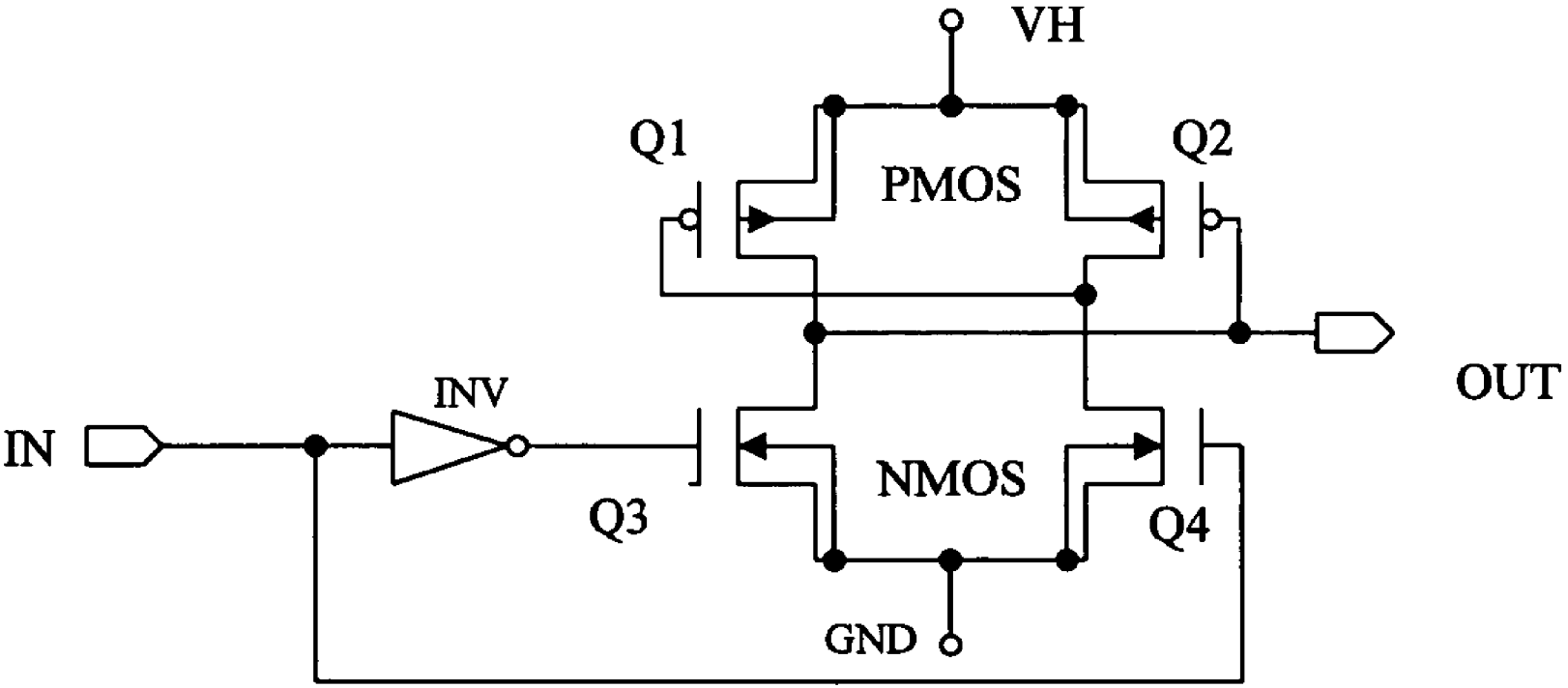
FIG. 8 illustrates an embodiment of the voltage level-shifter of this invention.

Without specific constraints, FIG. 8 is an embodiment of the voltage level shifter of this invention. Because the SEG driver voltage has a voltage greater than the numerical logic standard level (normally 3.3V); therefore, the ideal voltage level for the switched select signal of the voltage level selector must be at relatively high level. In order to form this type of select signal, the level shifter shown in FIG. 8 should be used. The level shifter allows the logic signal to switch level from 0-3.3V to 0-11V, matching the ideal level.

The level shifter has an N trench MOSFET Q3 and Q4 installed in the circuit on electric potential side and a P trench MOSFET Q1 and Q2 and phase inverter circuit INV installed on the high level side. The P trench MOSFET Q1 and Q2 are in stable condition allowing its gate and drain to cross connect. The drain of the N trench MOSFET Q3 and Q4 are connected to the drain of the P trench MOSFET Q1 and Q2 respectively. The input signal is sent to MOSFET Q4 gate. The input signal that has been negative phased through the phase converter circuit INV is sent to MOSFET Q3 gate. The output is from to the common connection between MOSFET Q1 drain and Q3 drain.

When the input signal is at a low level, the N trench MOSFET Q4 is at the cutoff region (turned off) and the output from the inverter circuit is high; therefore, the N trench MOSFET Q3 is turned on. The turned on condition of MOSFET Q3 causes P trench MOSFET Q2 to also be turned on. The cutoff region (turned off) of MOSFET Q4 causes P trench of MOSFET Q1 gate to be VH, causing Q1 to be at the cutoffregion (turned off). The output signal is at a low level.

When the input signal is changed from low to high, the N trench MOSFET Q4 is turned on, causing N trench of MOSFET Q3 to be in the cutoff region (turned off). The turned on of N trench Q2 causes the gate node Vg (the voltage at the gate) of P trench Q3 to swing to the low level side, resulting in Q1 being turned on. Q1 being turned on causes the Q2 Vg (the voltage at the gate) to recharge VH, causing Q2 to cutoff. The output signal is at the high level corresponding to the VH of the P trench MOSFET Q1 being turned on.

Figure 9:
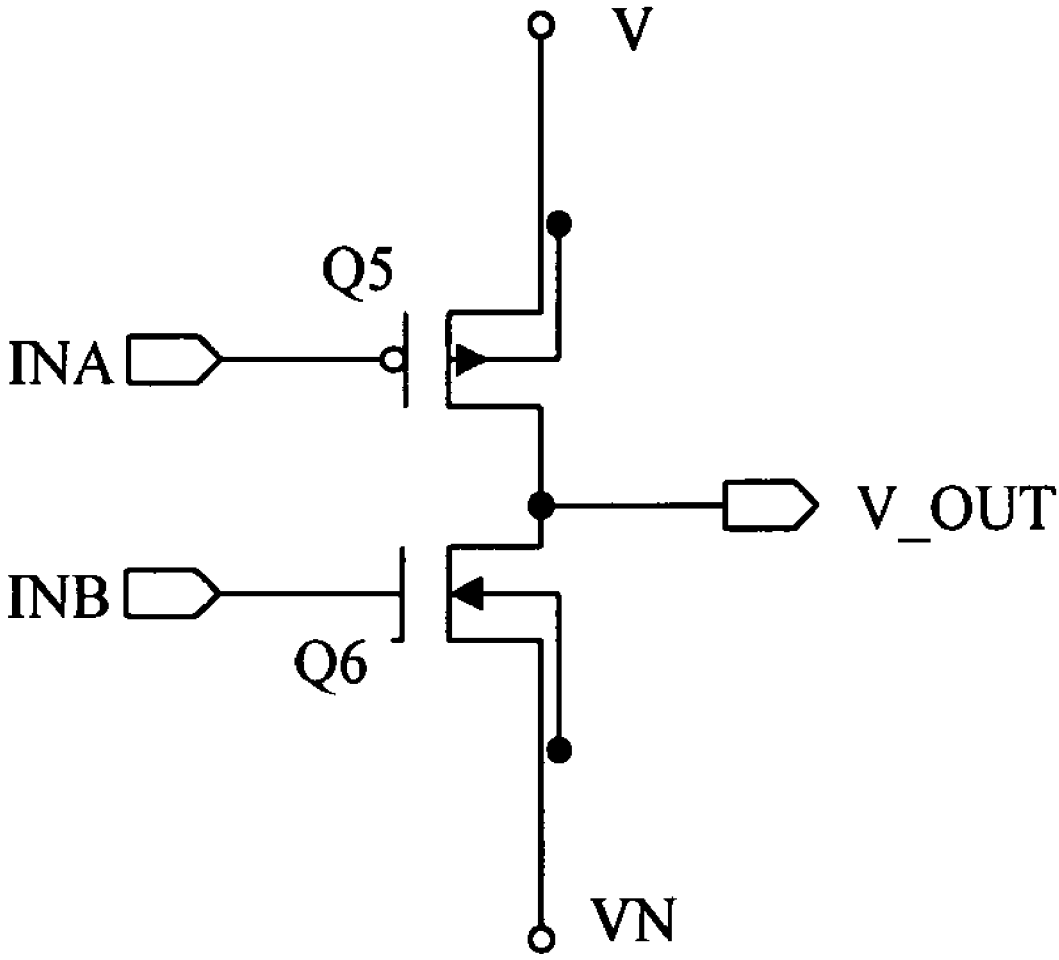
FIG. 9 illustrates an embodiment of the voltage level-selector of this invention.

FIG. 9 is an embodiment of voltage level selector circuit of this invention. The level selector has an N trench MOSFET Q6 installed in the circuit on the low level side and a P trench MOSFET Q5 installed on the high level side. The N trench MOSFET Q6 and P trench MOSFET Q5 are serially connected. The MOSFET Q6 drain is connected to the Q5 drain, and the output V_OUT is sent from the drain connection. The input signals INA and INB are sent to the gates of MOSFET Q5 and Q6 respectively.

The input signals INA and INB are non-overlapping signals. When the input signal INA is low, INB is also low, P trench of MOSFET Q5 is conducting, and N trench of MOSFET Q6 is cut off, resulting in a high level output voltage V. When the input signal INA is high, INB is also high, P trench of MOSFET Q5 is at cutoff region (turned oft) and N trench of MOSFET Q6 is turned on, resulting in a low level voltage VN. When the input signal INA is high and INB is low, both MOSFET Q5, Q6 are in the cutoff region (turned off), causing high output resistance. This circuit precludes input signals INA to be low and INB to be high at the input terminals.

While the present invention has been described with reference to certain preferred embodiments, it is to be understood that the present invention is not limited to such specific embodiments. Rather, it is the inventor's contention that the invention be understood and construed in its broadest meaning as reflected by the following claims. Thus, these claims are to be understood as incorporating not only the preferred embodiments described herein but also all those other and further alterations and modifications as would be apparent to those of ordinary skilled in the art.

We claim:

1. A method for processing a data signal in a LCD driver system, comprising the steps of:
- providing data to a SEG decoder;
- providing an array signal to the SEG decoder;
- SEG decoding the data and the array signal, comprising the substeps of:
  - performing an inverse operation on the array signal;
  - performing an XOR operation on the inversed array signal and the data; and
  - level selecting a decoded signal as a function of the output of the XOR operation;
- break-before-make processing the decoded signal;
- level shifting the to break before make-processed signal;
- level selecting the level-shifted signal; and
- sending the level-selected signal to a display panel;
- wherein in using said XOR operation, the SEG decoder comprises of a signal processor, a decoder circuit and a level control selector; wherein the signal processor comprises three identical 2-to-1 multiplexer and three identical phase inverters; wherein the decoder contains three identical XOR gates; and wherein the level control selector comprises XOR gates, three NAND gates and also a phase inverter.

2. The method of claim 1 wherein the SEG decoding step is performed by a decoding circuit that includes a combinational logic decoder, a voltage level control selector, a signal processor that first performs an inverse operation on the array signal; wherein the data signal and the array signal are simultaneously provided to the decoder for the XOR operation; wherein based on the output from the decoder, the voltage level control selector selects a corresponding level control signal before sending the signal to the break-before-make circuit.

3. A method for processing a data signal in a LCD driver system, comprising the steps of:
- providing data to a SEG decoder;
- providing array signal to the SEG decoder;
- SEG decoding the data and the output signal having the substeps of:
  - performing an inverse operation on the array signal;
  - performing an XOR operation on the inversed array signal and the data; and
  - level selecting a decoded signal as a function of the output of the XOR operation;
- break-before-make processing the decoded signal;
- level shifting the to break before make-processed signal;
- level selecting the level-shifted signal; and
- sending the level-selected signal to a display panel;
- wherein in using said XOR operation, the SEG decoder comprises of a signal processor, a decoder circuit and a level control selector; wherein the signal processor comprises three identical 2-to-1 multiplexer and three identical phase inverters; wherein the decoder contains three identical XOR gates; and wherein the level control selector comprises XOR gates, three NAND gates and also a phase inverter.

4. The method of claim 3 wherein the SEG decoding step is performed by a decoding circuit that includes a combinational logic decoder, a voltage level control selector, a signal processor that first performs an inverse operation on the array signal; wherein the data signal and the array signal are simultaneously provided to the decoder for the XOR operation; wherein based on the output from the decoder, the voltage level control selector selects a corresponding level control signal before sending the signal to the break-before-make circuit.

5. A circuit for processing a data signal in a LCD driver system, comprising:
- memory cells for holding data to be provided to a SEG decoder;
- an array for holding an array signal to be provided to the SEG decoder;
- a SEG decoder for decoding the data and the output signal comprising,
  - a signal processor, wherein the signal processor performs an inverse operation on the array signal;
  - an XOR decoder, wherein the XOR decoder performs an XOR operation on the inversed array signal and the data; and
  - a level selector, wherein the level selector selects a decoded signal as a function of the output of the XOR decoder;

a break-before-make circuit for processing the decoded signal;

a level shifter for shifting the to break before make-processed signal;

a level selector for selecting the level-shifted signal; and a display panel for receiving the level-selected signal;

wherein in using said XOR operation, the SEG decoder comprises of a signal processor, a decoder circuit and a level control selector; wherein the signal processor comprises three identical 2-to-1 multiplexer and three identical phase inverters; wherein the decoder contains three identical XOR gates; and wherein the level control selector comprises XOR gates, three NAND gates and also a phase inverter.

6. The circuit of claim 5 wherein in said SEG decoder, comprising:

a signal processor for performing an inverse operation on the array signal;

a decoder for performing a XOR operation on the inversed array signal and the data; and a level selector for selecting a decoded signal as a function of the output of the XOR operation.

7. The circuit of claim 5 wherein the SEG decoder is a decoding circuit that includes a combinational logic decoder, a voltage level control selector, a signal processor that first performs an inverse operation on the array signal; wherein the data signal and the array signal are simultaneously provided to the decoder for the XOR operation; wherein based on the output from the decoder, the voltage level control selector selects a corresponding level control signal before sending the signal to the break-before-make circuit.

8. The circuit of claim 5 wherein the segment driver circuit including a signal processor that can perform inverse operation on array signals and a decoding circuit that can perform a XOR operation; the displayed data is sent from the register to the SEG decoder; after it is processed by the SEG decoder, the resulting control signal is again processed by a BBM circuit, and its characteristics is: the signal processor first performs inverse operation on the array signal; the decoding circuit performs the XOR operation on the array signal that has been inversed before sending the signal to the break-before-make circuit.

9. The circuit of claim 8, wherein the decoding circuit includes a combinational logic decoder, a voltage level control selector, a signal processor that first performs an inverse operation on the array signal; wherein the data signal and the array signal that has been processed through the inverse operation are simultaneously input to the decoder for the XOR operation; wherein based on the output from the decoder, the voltage level control selector selects a corresponding level control signal before sending the signal to the break-before-make circuit.

* * * * *